US005860408A

United States Patent [19]

Summers

[11] Patent Number: 5,860,408

[45] Date of Patent: Jan. 19, 1999

[54] BOWSTRING PEEP SIGHT

[76] Inventor: Gregory E. Summers, 105 Overlink Ct., Lynchburg, Va. 24503

[21] Appl. No.: 781,150

[22] Filed: Jan. 9, 1997

[51] Int. Cl.[6] ..... F41G 1/467

[52] U.S. Cl. ..... 124/87; 124/90; 33/265

[58] Field of Search ..... 124/87, 90, 91, 124/92; 33/265

[56] References Cited

U.S. PATENT DOCUMENTS

| | | | |
|---|---|---|---|
| 2,488,597 | 11/1949 | Konold | 124/35.2 |
| 2,777,437 | 1/1957 | Allen | 124/91 |
| 2,905,166 | 9/1959 | Niemeyer | 124/91 |
| 3,410,644 | 11/1968 | McLendon | 33/265 X |
| 3,703,770 | 11/1972 | Sofield | 33/265 |
| 4,011,853 | 3/1977 | Fletcher | 124/87 |
| 4,086,904 | 5/1978 | Suski et al. | 124/90 |
| 4,134,369 | 1/1979 | Cook . | |
| 4,151,825 | 5/1979 | Cook . | |
| 4,656,747 | 4/1987 | Troncoso | 33/265 |
| 4,656,994 | 4/1987 | Jenks . | |
| 4,909,233 | 3/1990 | Stephenson | 124/91 |
| 4,930,485 | 6/1990 | Kopper | 124/91 |
| 4,965,938 | 10/1990 | Saunders | 33/265 |
| 4,981,128 | 1/1991 | Garvison | 124/35.2 |
| 5,016,603 | 5/1991 | Tentler | 124/91 |
| 5,170,771 | 12/1992 | Peck | 124/35.2 |
| 5,361,747 | 11/1994 | Laabs | 124/91 |
| 5,390,657 | 2/1995 | Larson | 124/91 |
| 5,499,620 | 3/1996 | Summers | 124/91 |
| 5,537,986 | 7/1996 | Summers | 124/91 |

*Primary Examiner*—John A. Ricci
*Attorney, Agent, or Firm*—Nixon & Vanderhye P.C.

[57] ABSTRACT

A peep sight device for a bowstring includes a pair of interengaged inner and outer sections, with a sight hole surrounded by a peripheral surface having a degree of taper such that substantially about 120° of natural light is available to the sight hole on each of two opposite sides of the device. The sight hole is formed in the inner section, with an adjacent, interior groove diverting a portion of the bowstring away from the bowstring centerline, thereby enabling the sight hole to lie on the centerline.

14 Claims, 3 Drawing Sheets

BOWSTRING PEEP SIGHT

This invention relates to a bowstring peep sight adapted for mounting directly to an archer's bowstring.

BACKGROUND AND SUMMARY OF THE INVENTION

In the field of archery, it is conventional practice to mount a peep sight on the bowstring, and to keep the sight in proper rotational alignment for accurate sighting of the target by the archer. It is difficult, however, to achieve precise rotational alignment of the peep sight, particularly with sights which are mounted between strands of the bowstring, and to maintain the alignment during a full draw.

The object of this invention is to provide an improved peep sight which is easy to install and precisely locatable on the bowstring. In addition, the unique design of the peep sight provides increased natural light to both sides of the sight hole.

In the exemplary embodiment, the peep sight is of two piece construction, with an inner piece or section being slidably receivable in a sideways direction within an outer piece or section. The sections are adapted to come together from opposite sides of the bowstring in a direction perpendicular to the latter, and in such a way as to sandwich the bowstring between the two sections. More specifically, the bowstring is moved laterally out of alignment with the longitudinal centerline of the bowstring, but retained within the peep sight, so as to insure alignment of the sight hole with the bowstring centerline. This is achieved by providing a groove on an interior side of the inner section of the peep sight, so that the bowstring is captured in the groove as the inner section moves into interfitting engagement with the outer section. More specifically, the groove is located in the free end of a transversely oriented stem, ahead of the sight hole in the direction of assembly/installation. After the two sections are interengaged along the bowstring, a fastening pin is inserted into aligned holes in the inner and outer sections.

Another feature of the invention lies in the provision for increased natural light on both sides of the sight hole. This is achieved by a beveled surface surrounding the sight hole which is formed in the inner section. A larger opening in the outer section aligns with the sight hole when the two sections are assembled, with a beveled surface surrounding the larger opening forming a continuation of the beveled surface surrounding the sight hole. These surfaces are tapered at an angle of about thirty degrees in all directions from the center axis of the hole (relative to a plane through the center of the peep sight separating the peep sight into front and rear halves), thereby enabling about 120° of natural light to reach the sight hole on each side thereof. The same configuration is provided on the opposite of the sight hole, thereby providing the same amount of light to the opposite side of the sight hole. As a result, better sighting is possible and low-light shooting time is extended.

The two piece assembly also facilitates quick and accurate installation without need for a bowpress, and since the peep sight is usable from either side, the amount of turning required in the event of bowstring twist is reduced.

In its broadest aspects, therefore, the present invention thus relates to a peep sight device for a bowstring comprising a pair of interengaged inner and outer sections and including a sight hole surrounded by beveled surfaces on both sides thereof having a degree of taper such that substantially about 120° of natural light is available to the sight hole on each of two opposite sides of the device.

In another aspect, the invention relates to a peep sight device for a bowstring comprising a pair of interengaged inner and outer sections, the inner section having a sight hole formed therein and an adjacent groove for diverting a portion of the bowstring away from a longitudinal axis of the bowstring, thereby enabling the sight hole to lie on the longitudinal axis.

Other objects and advantages will become apparent from the detailed description which follows.

DETAILED DESCRIPTION OF THE DRAWINGS

Figure 1:
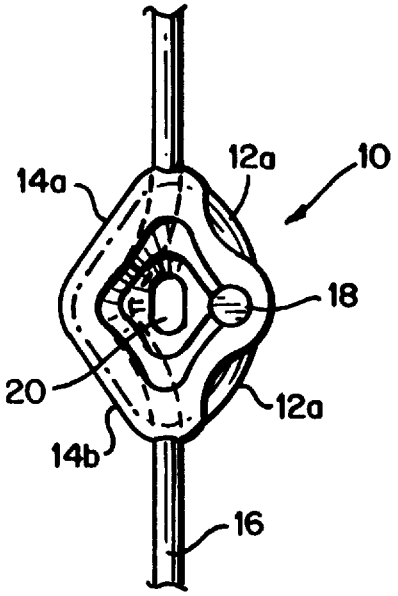
FIG. 1 is a rear elevation of the peep sight in accordance with the invention.
Figure 2:
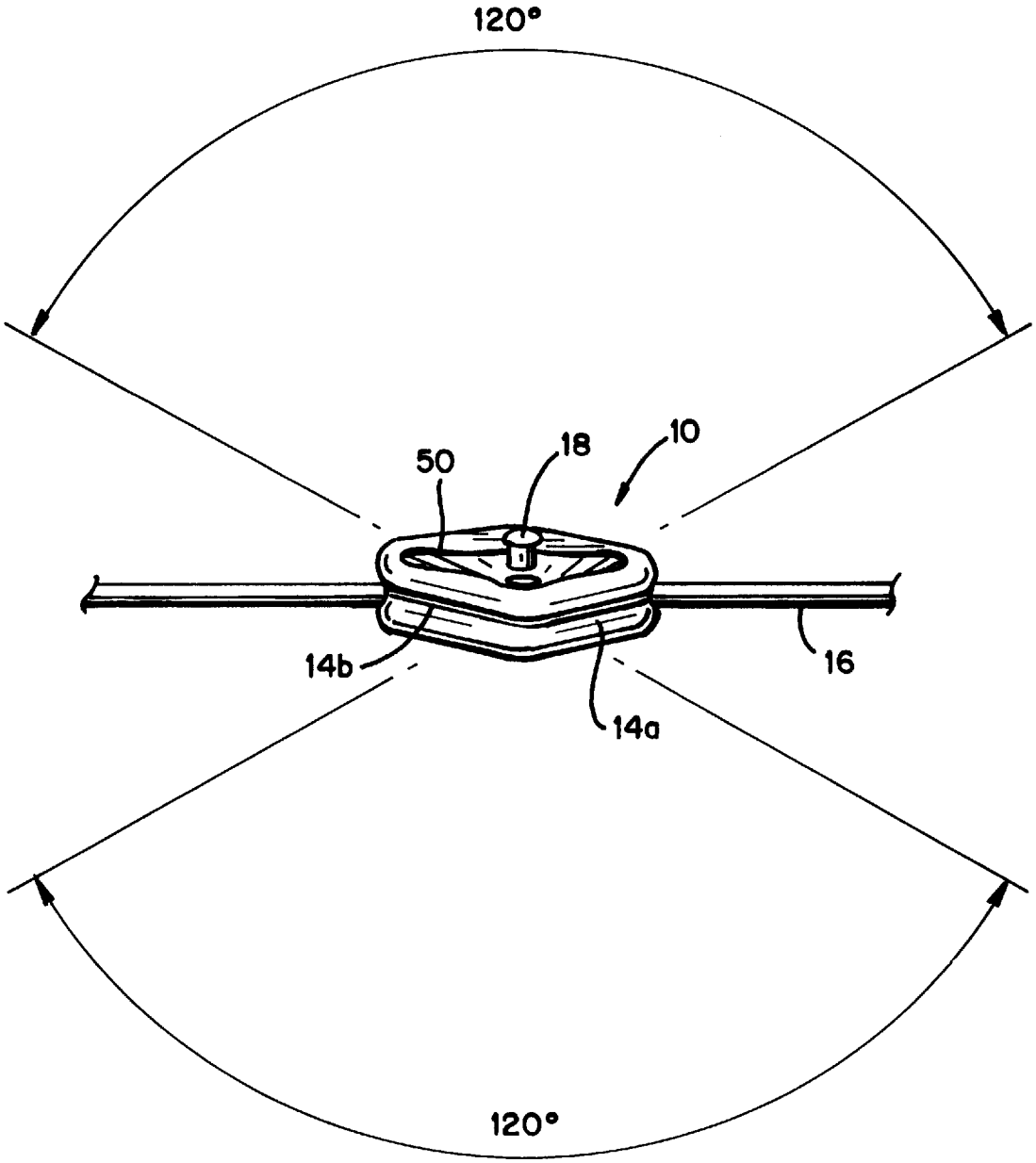
FIG. 2 is a perspective view of the peep sight in accordance with the invention, indicating the extent of natural light available to the sight hole.
Figure 3:
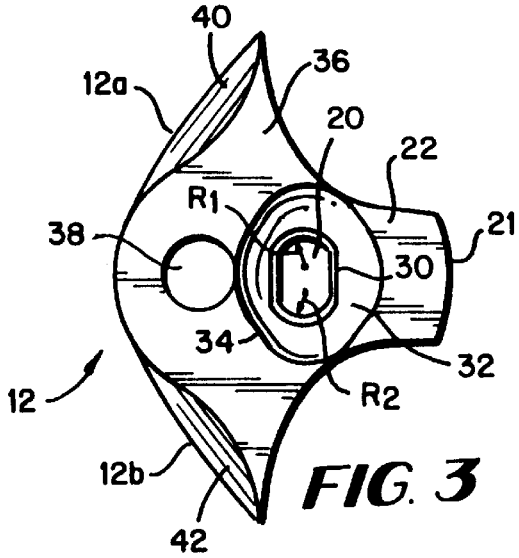
FIG. 3 is a side elevation of the inner section of the peep sight.

With reference to FIGS. 1–3, the peep sight 10 in accordance with this invention includes two sections, one of which may be referred to as an "inner" section 12 while the other may be referred to as an "outer" section 14. As will be explained further below, the inner section 12 is slidably received within the outer section 14 in a sideways horizontal direction (sandwiching the vertical bowstring 16 therebetween), and is secured by the utilization of a pin 18. Since the bowstring 16 is substantially vertical when in a relaxed state with the bow held in a generally upright (or firing) position, reference will be made herein to vertical and horizontal directions consistent therewith. Thus, the pin 18 may be said to extend in a horizontal direction but perpendicular to the horizontal direction of movement of the components during assembly.

More specifically, the peep sight 10 is generally of rounded diamond-shape, (with four sides 12*a*, 12*b*, 14*a*, 14*b*) when viewed from the front or rear, as mounted on the bowstring (so that the "front" faces the target and the "rear" faces the archer), with a sight hole 20 centered along a vertical line defined by the bowstring and by the longitudinal axis of the peep sight. To so locate the sight hole 20, the bowstring 16 is offset from its own centerline within the peep sight body as described further below.

Figure 4:
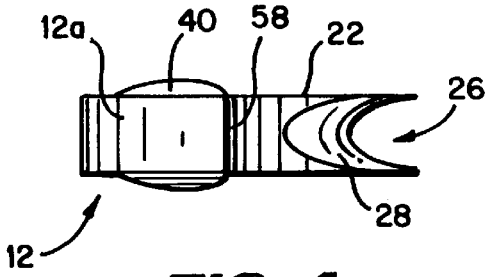
FIG. 4 is a plan view of FIG. 3.

With specific reference to FIGS. 3 and 4, the inner section 12 completes the diamond-shaped body by completing the sides 12*a* and 12*b*. Extending transversely of the longitudinal axis of the peep sight is a stem 22 formed at its free end 24 with a groove 26 having a bowstring supporting surface 28. In the approximate center of the inner section 12 is the sight hole 20. The latter is slightly elongated, with a pair of radiused ends connected by a straight center. In other words, the radiused ends are generated from vertically spaced (as viewed in FIG. 2) centers $R_1$, $R_2$. For the hole interior, $R_1$ and $R_2$ may be 0.0402 inch. The hole interior is surrounded by a beveled edge 30, with a corresponding radii of 0.062 inch. These dimensions may vary, however. A more shallow beveled surface 32 has a shape generally similar to the exterior outline of the peep sight, and extends to a larger peripheral edge 34 at the flat interior surface 36 of the inner section 12. A fastener hole 38 lies adjacent the sight hole 20, on the opposite side of sight hole 20 from the stem 22. The upper and lower sides 12*a*, 12*b* also include laterally curved projections 40, 42, respectively, which partially wrap about the outer section 14 as described further below.

Figure 6:
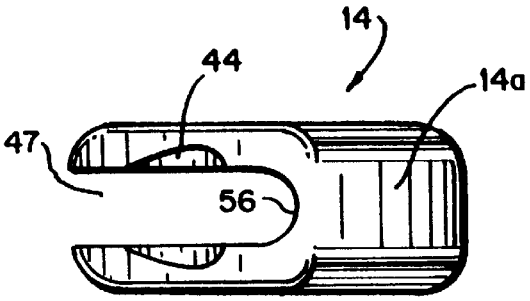
FIG. 6 is a plan view of FIG. 5.
Figure 5:
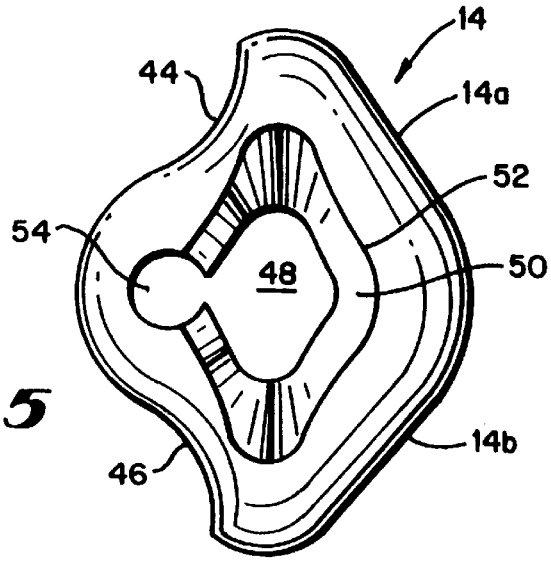
FIG. 5 is a side elevation of the outer section of the peep sight.

Turning to FIGS. 5 and 6, the outer section 14 is generally of rounded diamond shape, but formed with relieved areas 44, 46 along an open side edge 47 by which the inner section 12 can be received within the hollow interior of the outer section. The relieved areas 44, 46 receive the projections 40, 42 to thereby complete the side contours of the peep sight.

A center aperture 48 is slightly larger but of the same generally oval shape as the edge 34 in the inner section. When the inner and outer sections 12 and 14 are aligned upon assembly, the edge of aperture 48 aligns with the edge 34 to form a continuous beveled surface 32, 50 from the sight hole 20 to the peripheral edge 52 surrounding the aperture 48. The edge 52 is also of a generally rounded diamond shape but is more elongated in the vertical direction, i.e., along the centerline of the bowstring and longitudinal axes of the peep sight. The beveled edge configuration is identical on both sides of the inner and outer sections 12, 14, so that the sight hole configuration is exactly the same on front and rear sides of the sight.

A fastener recess or aperture 54 adjacent the aperture 48 is alignable with fastener hole 38 on the inside section 12, and the pin 18 may be press fit into the aligned apertures 38, 54 to hold the sections 12 and 14 together. Other fastener arrangements, however, may be employed.

With reference back to FIG. 2, the beveled surfaces 32, 50 surrounding the sight hole 20 on both sides of the device establish a natural light capture angle of about 120° on each side of the sight hole. This arrangement permits greater sighting accuracy and extends low light shooting time for the archer.

Figure 7:
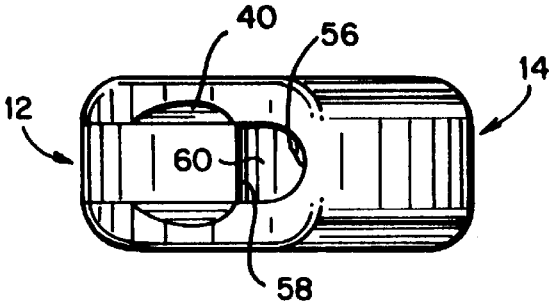
FIG. 7 is a plan view of the assembled peep sight.

Returning to FIGS. 1, 6 and 7, the upper and lower edges of the outer section 14 are cut out at 56 (only the upper edge shown in FIGS. 6 and 7) so that, in cooperation with an edge 58 of the inner section (see FIG. 7), a non-round bowstring aperture 60 is created. Thus, the bowstring 16 enters and exits the peep sight at upper and lower locations as shown in FIG. 1, with the non-round holes insuring good gripping action against the bowstring.

Figure 1A:
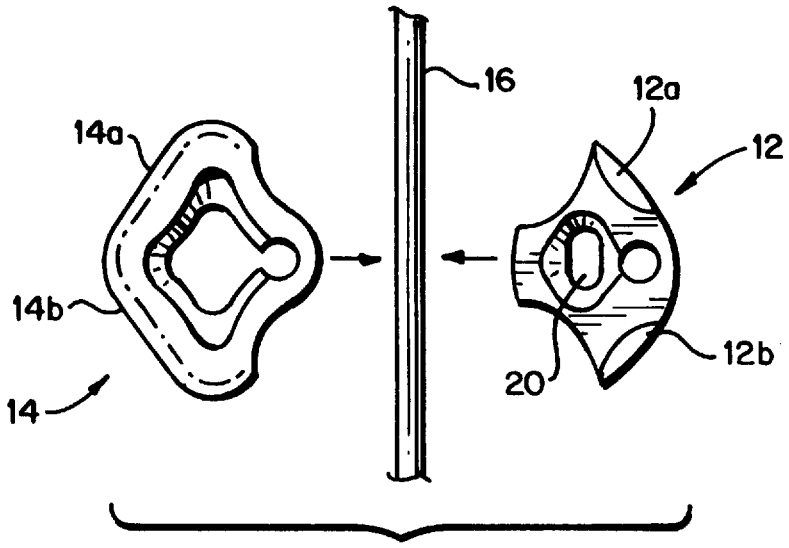
FIG. 1A is an exploded view of the peep sight components shown in FIG. 1.

To install the sight on a bowstring, the components of the sight (inner and outer sections 12 and 14, respectively) are located as shown in FIG. 1A. The bowstring 16 is engaged within the groove 28 of the inner section 12 and then pushed into the outer section 14 with vertically spaced portions of the bowstring received within the cut-outs 56. As a result, the bowstring 16 is sandwiched between the groove 28 of the inner section 12 and the interior surface of the outer section 12, as shown in dotted lines in FIG. 1. Note also that the projections 40, 42 fill in the relieved areas 44, 46, creating three dimensional interlock between the inner and outer sections 12, 14 while also creating a smooth, continuous surface about the periphery of the device.

After the sight is properly located on the bowstring, the pin 18 is press fit into the aligned apertures 36 and 50 to securely hold the sight sections together. A screw or other suitable fastener may be employed in place of pin 18, if desired.

It will be appreciated that, in use, with the bowstring drawn at an angle to vertical, the elongated sight hole 20 will appear as a round hole to the archer, with the hole flooded by increased natural light (approximately 240°) for greater siting accuracy. The two-piece construction of the peep sight also reduces peep sight "orbit" common with sights engaged between strands of the bowstring, thus providing even greater siting accuracy.

The peep sight as described above may be constructed of plastic, aluminum, or other suitable material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A peep sight device for a bowstring comprising a pair of interengaged inner and outer sections, and including a sight hole surrounded by a peripheral surface having a degree of taper such that substantially about 120° of natural light is available to the sight hole on each of two opposite sides of the device, and wherein a groove is provided on the inner section on one side only of said sight hole for receiving the bowstring and for diverting said bowstring to said one side of said sight hole.

2. The device of claim 1 wherein the sight hole is located such that, when installed on the bowstring, the sight hole lies on the longitudinal centerline of the bowstring.

3. The device of claim 2 wherein said sight hole is elongated in the direction of said longitudinal centerline.

4. The device of claim 1 including a fastener adapted to secure said inner and outer sections together.

5. The device of claim 4 wherein said fastener comprises a pin, and wherein said inner and outer sections have aligned holes for receiving said pin.

6. The device of claim 1 wherein said groove is formed in said inner section, opening in a direction perpendicular to the bowstring length.

7. A peep sight device for a bowstring comprising a pair of interengaged inner and outer sections, and including a sight hole surrounded by a peripheral surface having a degree of taper such that substantially about 120° of natural light is available to the sight hole on each of two opposite sides of the device, wherein said sight hole is formed in said inner section and further wherein said outer section is formed with a larger aperture surrounding said sight hole.

8. The device of claim 7 wherein said sight hole has a first peripheral beveled edge which merges with a second peripheral beveled edge around said larger aperture to form said peripheral surface.

9. A peep sight device for a bowstring comprising a pair of interengaged inner and outer sections, and including a sight hole surrounded by a peripheral surface having a degree of taper such that substantially about 120° of natural light is available to the sight hole on each of two opposite sides of the device, and wherein said inner and outer sections combine to provide a pair of bowstring holes, both of which are non-round.

10. A peep sight device for a bowstring comprising a pair of interengaged inner and outer sections, said inner section having a sight hole formed therein and an adjacent groove on one side only of said sight hole for diverting said bowstring around said sight hole, thereby enabling said sight hole to lie on a longitudinal centerline of the bowstring.

11. The device of claim 10 including a fastener adapted to secure said inner and outer sections together.

12. The device of claim 11 wherein said fastener comprises a pin, and wherein said inner and outer sections have aligned holes for receiving said pin.

13. The device of claim 10 wherein said sight hole is elongated in the direction of said longitudinal centerline.

14. A peep sight device for a bowstring comprising a pair of interengaged inner and outer sections, said inner section having a sight hole formed therein and an adjacent groove for diverting said bowstring, thereby enabling said sight hole to lie on a longitudinal centerline of the bowstring, and wherein said inner and outer sections combine to provide a pair of bowstring holes, both of which are non-round.

* * * * *